US006443037B1

(12) United States Patent
Chang

(10) Patent No.: US 6,443,037 B1
(45) **Date of Patent: *Sep. 3, 2002**

(54) SCREWDRIVER GRIP STRUCTURE

(76) Inventor: Chen-Chi Chang, No. 32, Yu Che Tien, Kuo Hsi Li, Ta Lin Town, Chiayi Hsein (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/711,147

(22) Filed: Nov. 14, 2000

Related U.S. Application Data

(63) Continuation-in-part of application No. 09/661,145, filed on Sep. 13, 2000, now abandoned.

(51) Int. Cl.[7] ..... B25B 13/46
(52) U.S. Cl. ..... 81/62; 81/490; 81/177.4
(58) Field of Search ..... 81/58.4, 60–63.2, 81/177.4, 490

(56) References Cited

U.S. PATENT DOCUMENTS 3,824,881 A * 7/1974 Wright ..... 81/63
4,485,699 A * 12/1984 Fuller ..... 81/63.1 X
4,976,175 A * 12/1990 Hung ..... 81/490 X
5,174,178 A * 12/1992 Disston ..... 81/490
5,228,363 A * 7/1993 Corona et al. ..... 1/490 X
5,749,271 A * 5/1998 Liu ..... 81/60
5,806,381 A * 9/1998 Lin ..... 81/58.4
6,237,451 B1 * 5/2001 Wei ..... 81/177.4 X

* cited by examiner

*Primary Examiner*—James G. Smith
(74) *Attorney, Agent, or Firm*—Rosenberg, Klein & Lee

(57) ABSTRACT

A screwdriver grip structure including a grip and a ratchet mechanism. A rear section of the grip is formed with a differential hole having a profile complementary to the profile of the ratchet seat of the ratchet mechanism so that the ratchet seat is positioned in the differential hole and restricted thereby from rotating. A connecting rod of the ratchet mechanism forward extends in the grip. A sleeve is fitted into a central hole of the grip from front end thereof to connect with the connecting rod. The sleeve has a large diameter section and the central hole of the grip has an enlarged section corresponding to the large diameter section. The large diameter section is engaged in and leant against the enlarged section of the central hole of the grip so as to bear greater axial application force. The front end of the sleeve has a tool connecting section for connecting with various kinds of tool heads.

4 Claims, 11 Drawing Sheets

SCREWDRIVER GRIP STRUCTURE

CROSS-REFERENCE TO RELATED APPLICATION

This application is a Continuation-In-Part Application of Ser. No. 09/661,145, filed Sep. 13, 2000, and entitled "Screwdriver Grip Structure." Now abandoned.

BACKGROUND OF THE INVENTION

The present invention relates to an improved screwdriver grip structure, and more particularly to a screwdriver grip structure which is able to firmly connect with an elongated tool head and can be easily carried. Moreover, the screwdriver grip structure is able to bear greater axial application force.

FIGS. 7 and 8 show a conventional screwdriver having a grip 8. The rear section of the grip 8 is formed with a differential hole 81 having a profile complementary to the profile of the ratchet seat 91 of the ratchet mechanism 9. The ratchet seat 91 is restricted by the wall of the differential hole 81 from rotating. A cap 82 is screwed on the rear end of the grip 8 for fixing the ratchet mechanism 9. A connecting rod 92.of the ratchet mechanism 9 forward extends in the grip 8 for connecting with a cooperative elongated tool head 93.

In use, an axial pushing force is exerted onto the tool head 93 for leaning the tool head against a work piece. The ratchet mechanism 9 is fixed in the differential hole 81 by the cap 82 screwed on the grip 8 so that the axial application force of the tool head 93 will be totally borne by the cap 82. Accordingly, in the case of greater application force of the tool head 93, the cap 82 may be pushed away by the ratchet mechanism 9 and the ratchet mechanism 9 may drop out of the grip 8.

FIGS. 9 and 10 show another type of conventional screwdriver having a grip 7. The grip 7 is formed with multiple elongated receiving cavities 71 extending from front end to rear end. Multiple elongated tool heads 72 are received in the receiving cavities 71. A cap 73 is disposed at front end of the grip 7 for stopping the tool heads 72 from dropping out of the receiving cavities 71. The cap 73 is formed with an opening 731 corresponding to the receiving cavities 71, whereby the tool heads 72 can extend outward through the opening 731. The cap 73 is formed with a central through hole 732 corresponding to a connecting socket 701 of the grip 7. The opening 731 extends toward the center of the cap 73 and communicates with the central through hole 732. After the tool head 72 extends out, an enlarged section (not shown) of rear end of the tool head 72 is engaged in the opening 731 to prevent the tool head 72 from dropping out from the cap 73. Then the tool head 72 is transversely moved into the through hole 732 and inserted into the connecting socket 701 of the grip 7. Accordingly, the tool head 72 is fixed in the grip 7 for use.

Such screwdriver is able to conveniently receive elongated tool heads 72 and can be easily carried. However, the cap 73 is disposed at front end of the grip 7 so that it is impossible to lay a ratchet mechanism in the front end of the grip 7 as the conventional ratchet screwdriver. This leads to inconvenience in use. Furthermore, the rear end of the tool head 72 is formed with an enlarged section for engaging in the opening 731. This increases difficulty in manufacturing and cost therefor.

SUMMARY OF THE INVENTION

It is therefore a primary object of the present invention to provide a screwdriver grip structure in which the connecting rod of the ratchet mechanism disposed in the rear section of the grip is connected with a sleeve fitted into the grip from front end thereof. The tool head is connected with the sleeve. The sleeve has a large diameter section and the central hole of the grip has an enlarged section for the large diameter section to engage therein. The large diameter section of the sleeve is leant against the enlarged section so as to bear greater axial application force in use of the screwdriver. Therefore, the screwdriver is more durable.

It is a further object of the present invention to provide the above screwdriver grip structure in which the grip is formed with multiple elongated receiving cavities extending from front end to a portion near rear end. Therefore, various kinds of tool heads can be placed in the receiving cavities of the grip so as to greatly reduce the volume of the tool kit for easy carriage.

The present invention can be best understood through the following description and accompanying drawings wherein:

DETAILED DESCRIPTION OF THE PREFERRED EMBODIMENT

Figure 1:
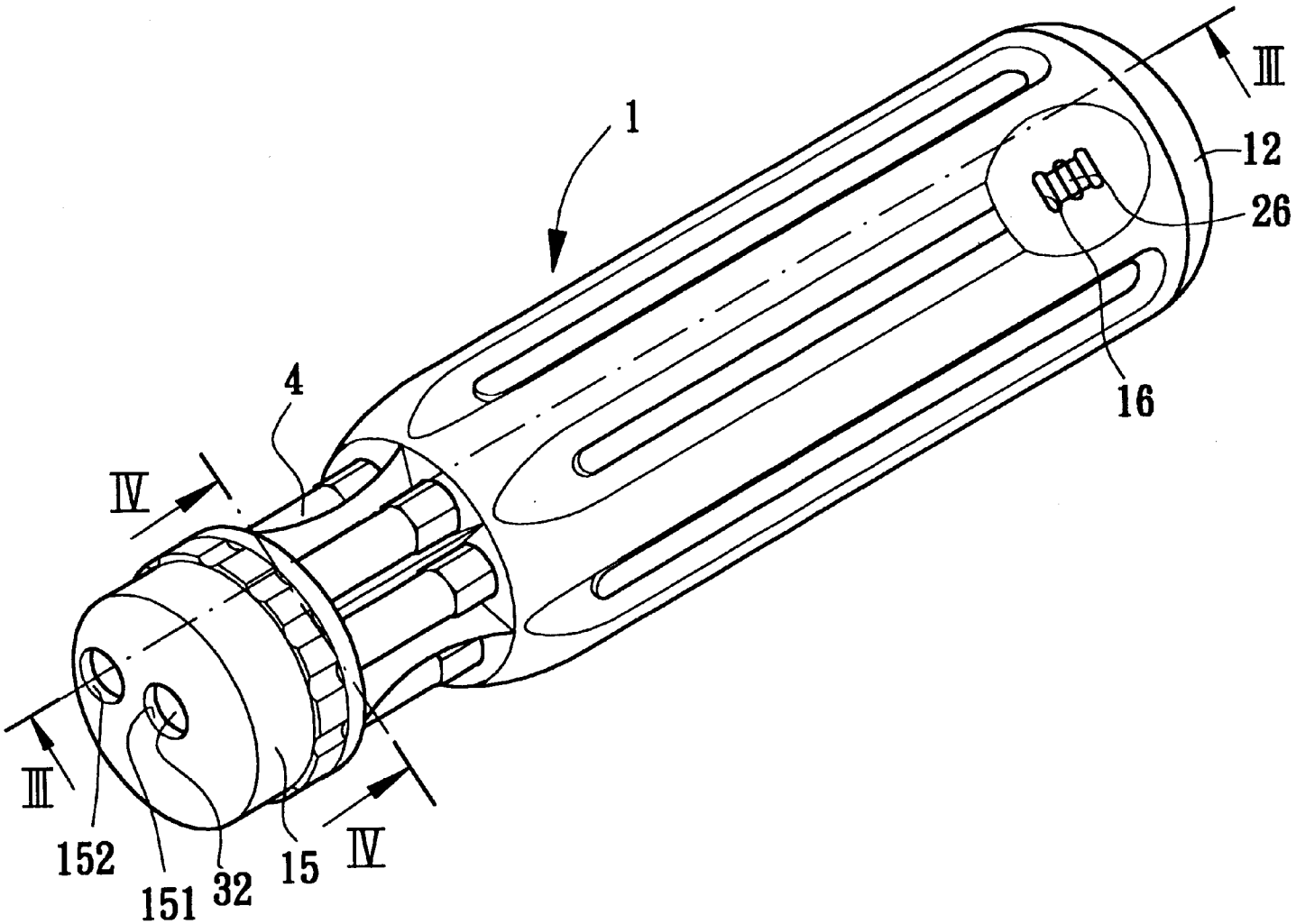
FIG. 1 is a perspective assembled view of the present invention.
Figure 2:
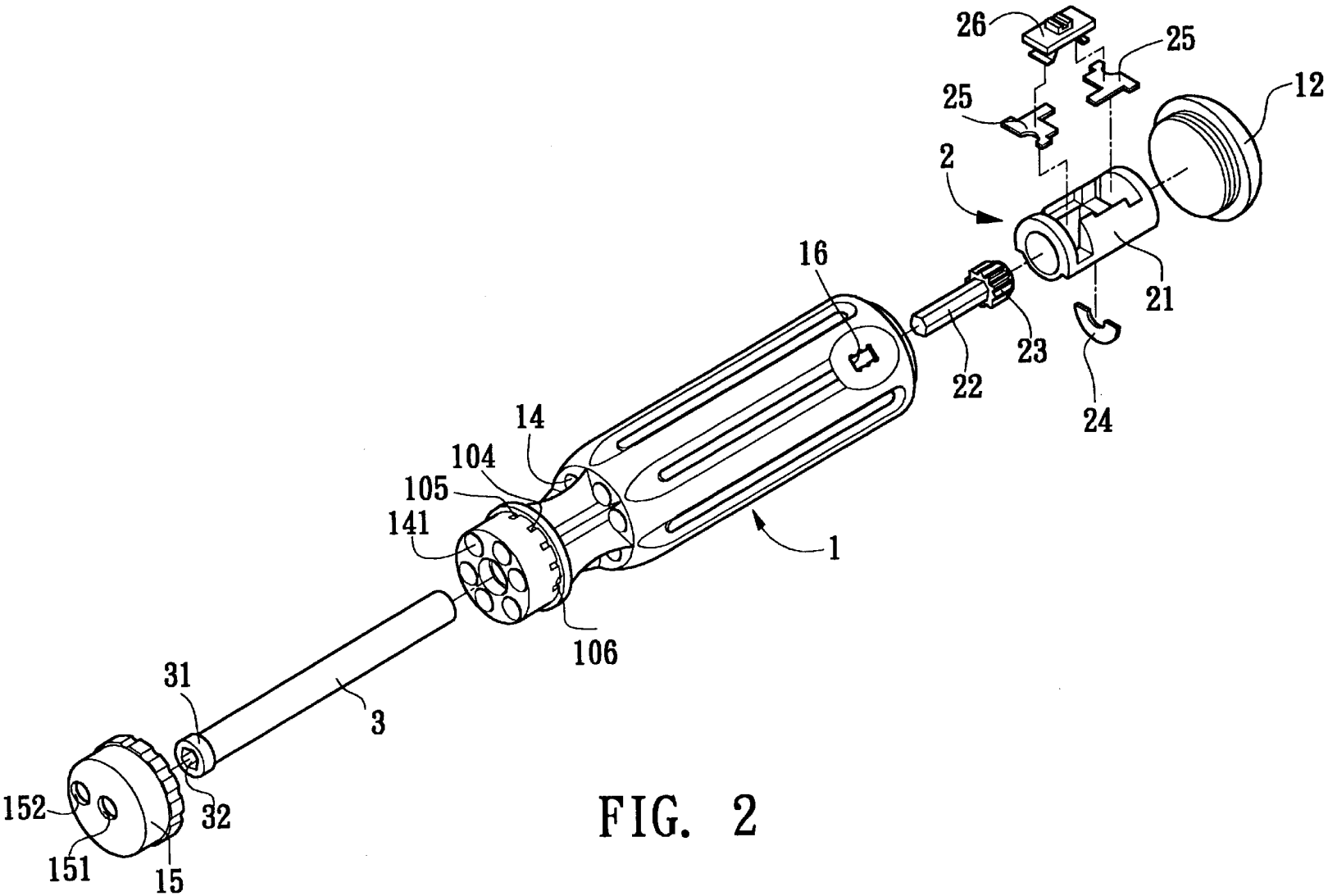
FIG. 2 is a perspective exploded view of the present invention.
Figure 3A:
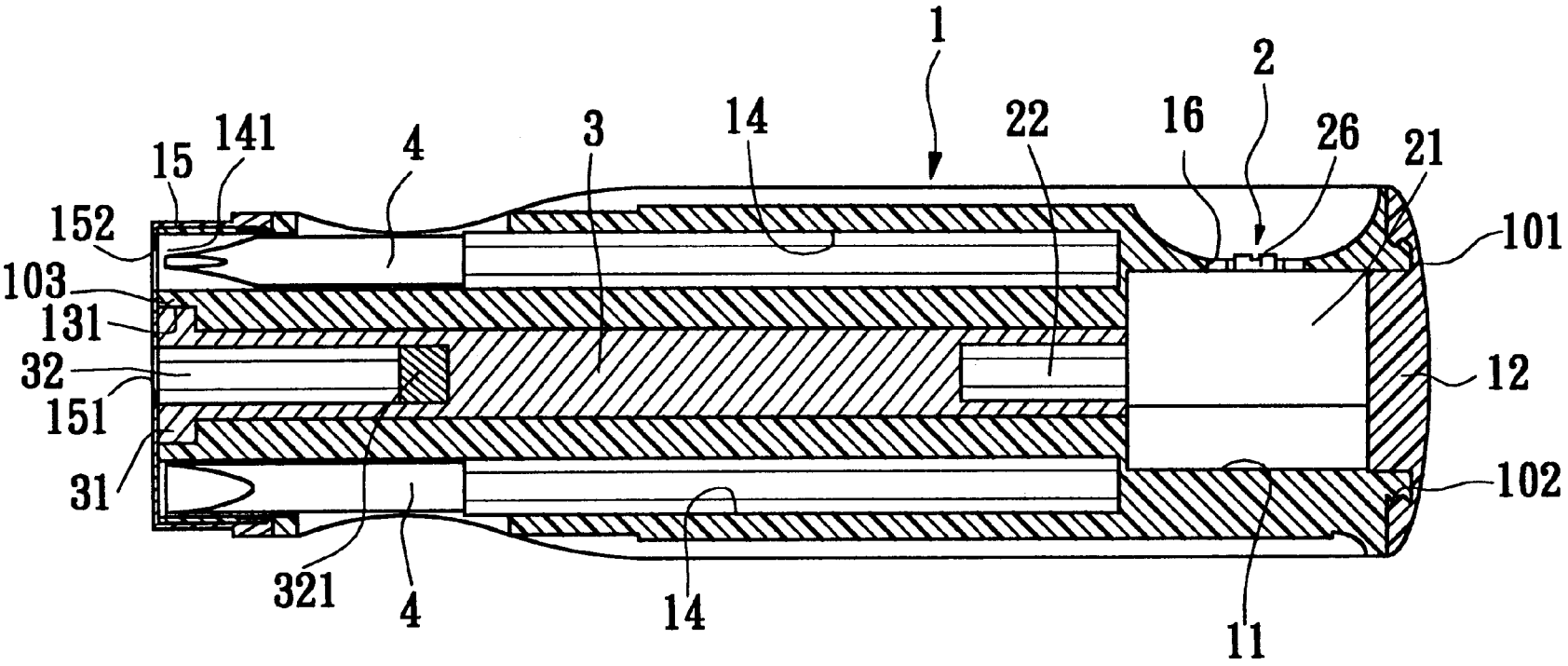
FIG. 3A is a sectional view taken along line III—III of FIG.
Figure 3B:
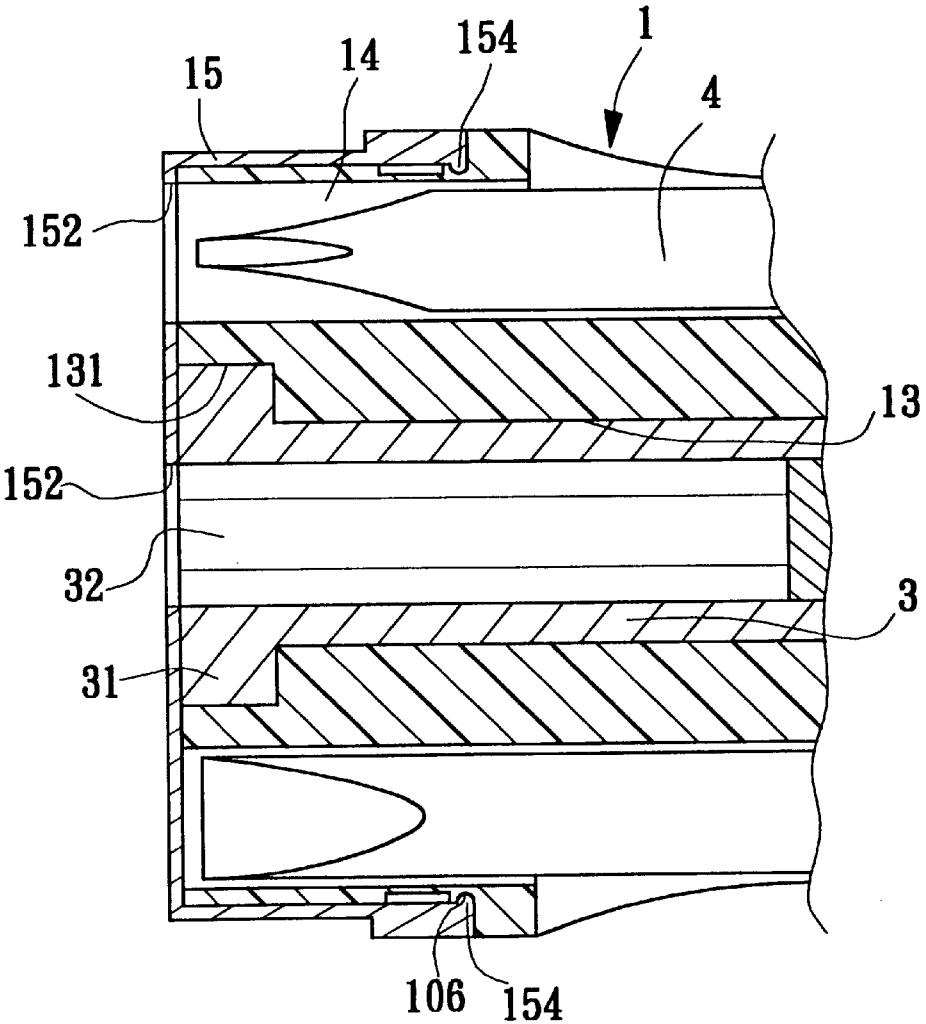
FIG. 3B is an enlarged view of a part of FIG. 3A.
Figure 4:
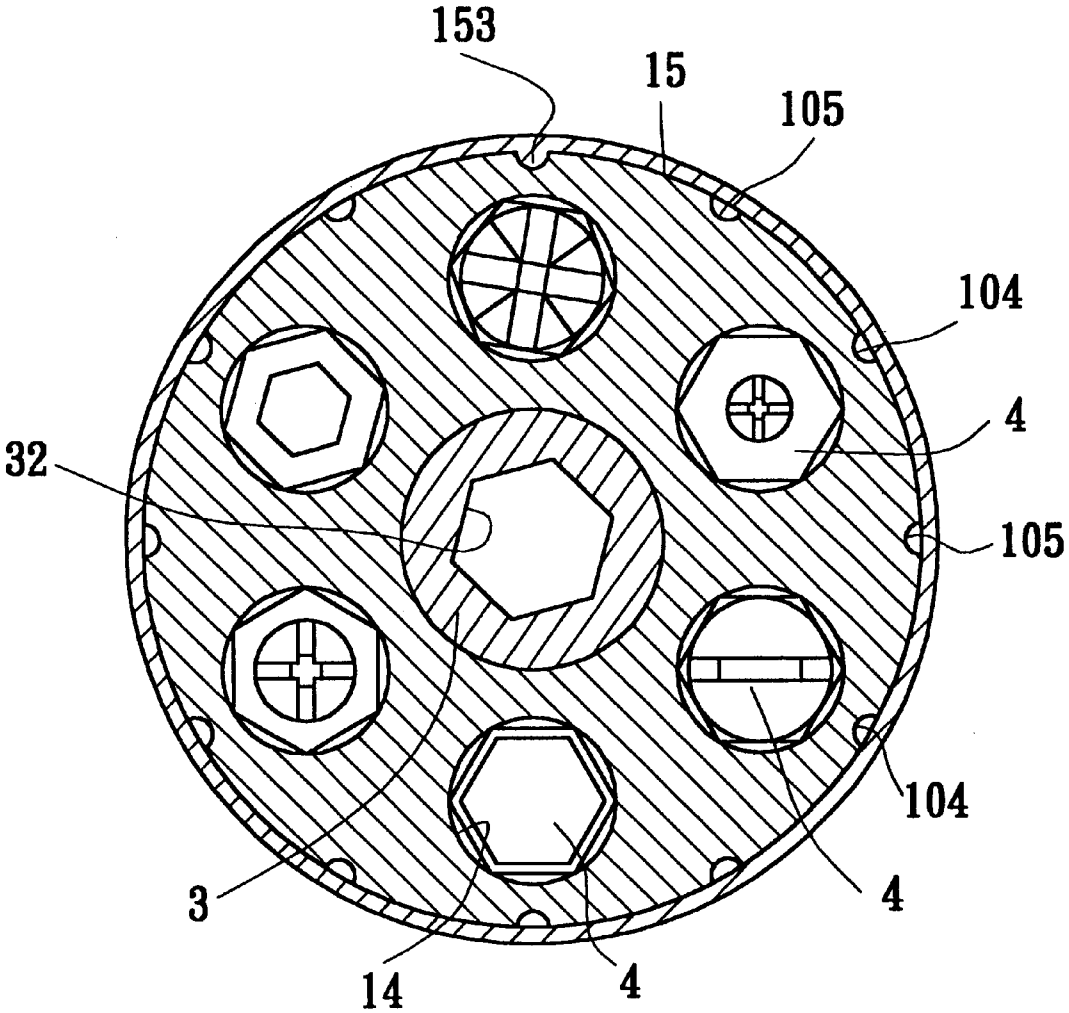
FIG. 4 is a sectional view taken along line IV—IV of FIG. 1.

Please refer to FIGS. 1 to 4. The screwdriver grip structure of the present invention includes a grip 1. A ratchet mechanism 2 is disposed in the grip 1. The ratchet mechanism 2 includes a ratchet seat 21. A rear section of the grip 1 is formed with a differential hole 11 forward extending from rear end of the grip 1. The differential hole 11 has a profile complementary to the profile of the ratchet seat 21. The ratchet seat 21 is placed into the differential hole 11 from the rear end 101 of the grip 1. The rear end 101 of the grip 1 is formed with a thread section 102 on which a cap member 12 is screwed for fixing the ratchet mechanism 2 in the grip 1. A connecting rod 22 is rotatably disposed in the ratchet seat 21 of the ratchet mechanism 2. One end of the connecting rod 22 has a ratchet 23 in the ratchet seat 21. A chuck plate 24 is positioned under the ratchet seat 21 for restricting the ratchet 23 within the ratchet seat 21. A stop plate 25 and a switch 26 are installed in the ratchet seat 21. The grip 1 is formed with a window 16 corresponding to the switch 26, whereby the switch 26 can protrude out of the grip 1. By means of the switch 26, the rotational direction of the ratchet 23 of the ratchet mechanism 2 can be controllably changed. The connecting rod 22 is connected with a sleeve 3. The grip 1 is formed with a central hole 13, whereby the sleeve 3 is fitted from the front end 103 of the grip 1 into the central hole 13 to connect with the connecting rod 22. The front end of the sleeve 3 has a large diameter section 31. The front end of the central hole 13 is formed with an enlarged section 131 corresponding to the large diameter section 31. In addition, the front end of the sleeve 3 has a tool connecting section 32 in which a magnet 321 is disposed for connecting with various kinds of tool heads 4. The circumference of the grip 1 is formed with several elongated receiving cavities 14 extending from front end to a portion near rear end. Each receiving cavity 14 has an opening 141 facing forward for receiving various kinds of elongated tool heads 4. A rotary cap member 15 is fitted on front end 103 of the grip 1. The grip 1 is formed with an annular groove 106. The cap member 15 is formed with a stop flange 154 corresponding to the annular groove 106. The stop flange 154 cooperates with the annular groove 106 for preventing the cap member 15 from axially moving. The cap member 15 is formed with a through hole 151 corresponding to the central hole 13 of the grip 1. In addition, the cap member 15 is formed with an opening 152 corresponding to the receiving cavities 14. The cap member 15 can be rotated to align the opening 152 with the respective receiving cavities 14 for taking out and placing in the tool heads 4. The inner circumference of the cap member 15 has a protuberance 153. The outer circumference of the front end 103 of the grip 1 is formed with multiple dents 104 for the protuberance 153 to engage therein. When the protuberance 153 is engaged in each of the dents 104, the opening 152 of the cap member 15 is aligned with the opening 141 of one of the receiving cavities 14. A second dent 105 is formed between each two adjacent dents 104. When the protuberance 153 is engaged in any of the second dents 105, the opening 152 of the cap member 15 is disaligned from all the openings 141 of the receiving cavities 14 so as to seal the receiving cavities 14.

Figure 5:
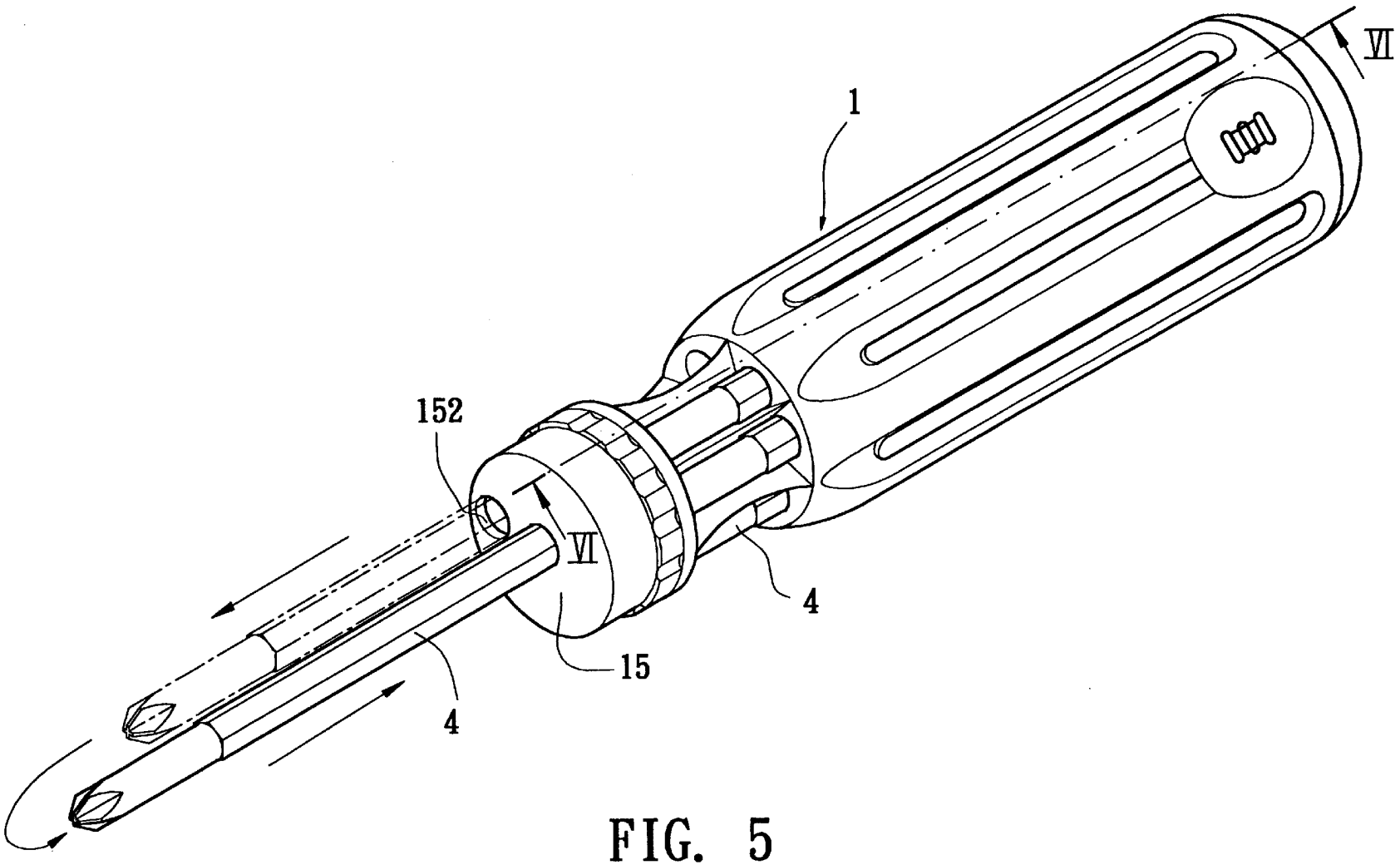
FIG. 5 shows the use of the present invention.
Figure 6:
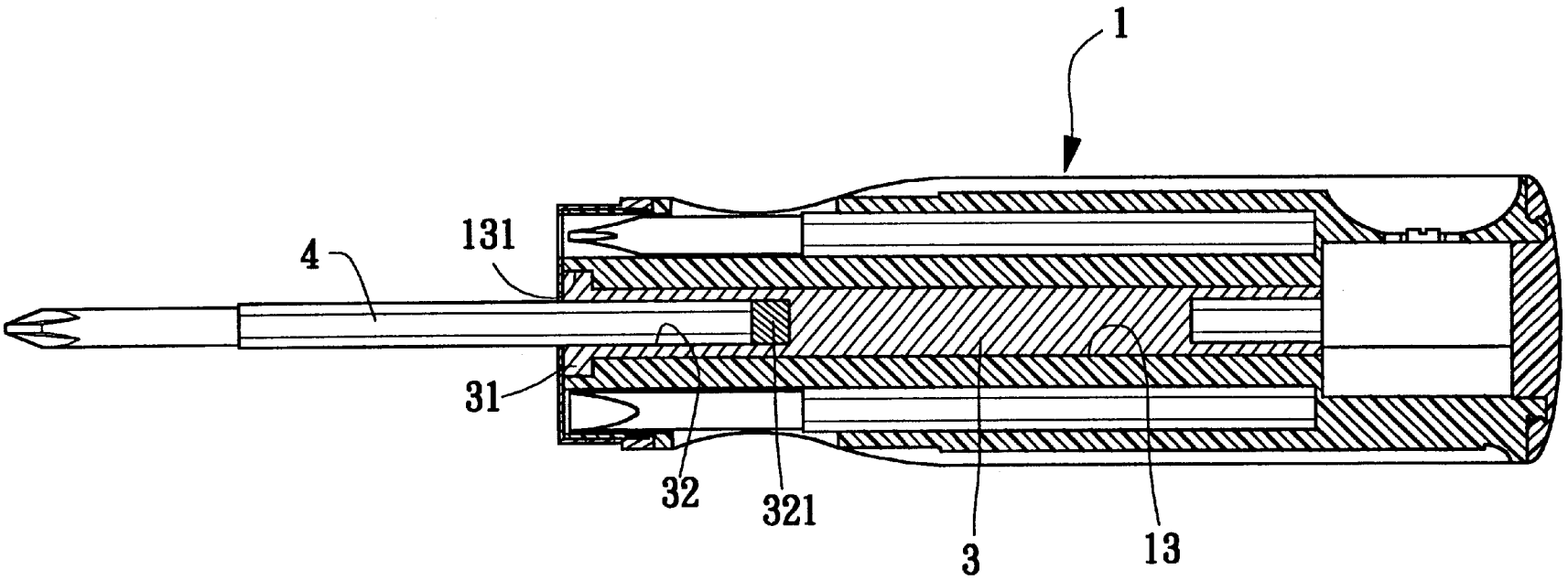
FIG. 6 is a sectional view taken along line VI—VI of FIG. 5.
Figure 7:
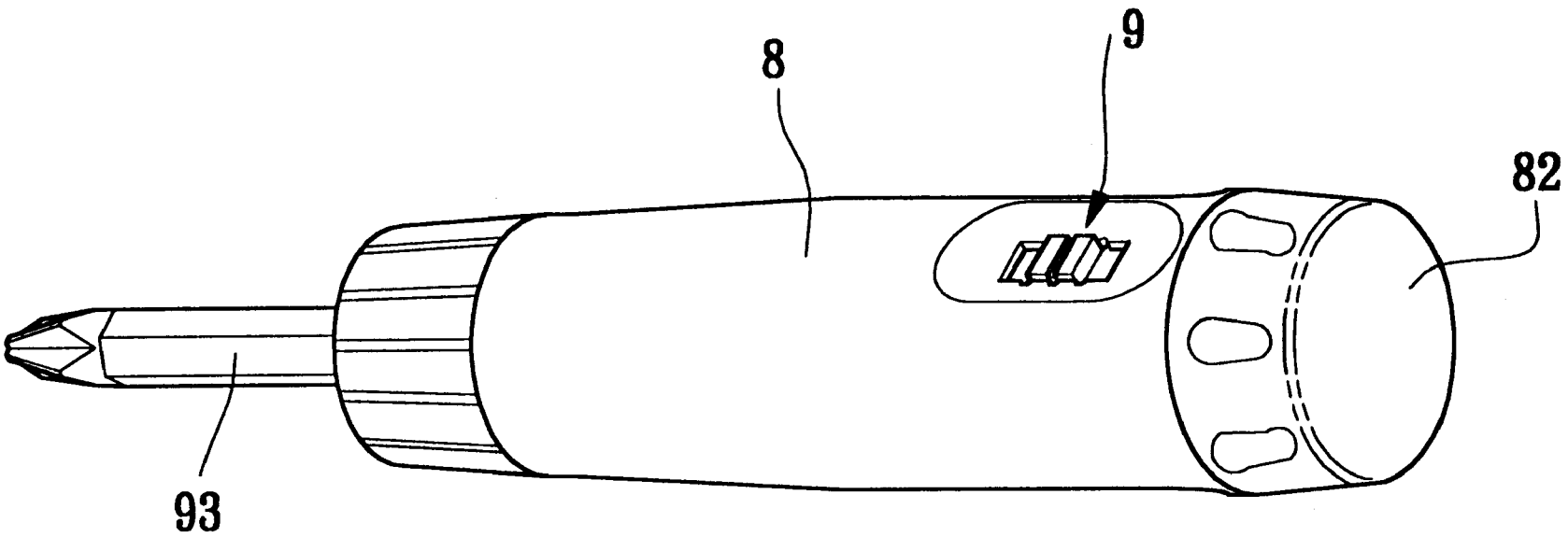
FIG. 7 PRIOR ART
FIG. 7 is a perspective view of a conventional screwdriver grip structure.
Figure 8:
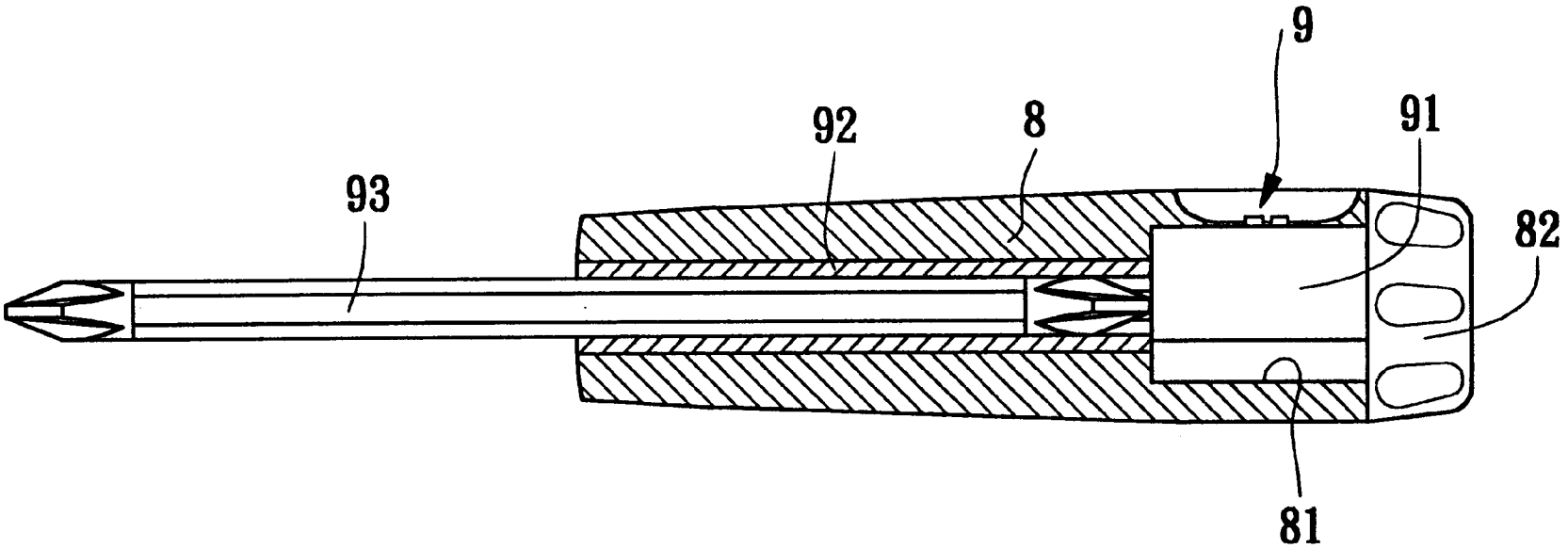
FIG. 8 PRIOR ART
FIG. 8 is a sectional view of the conventional screwdriver grip structure of FIG. 7.
Figure 9:
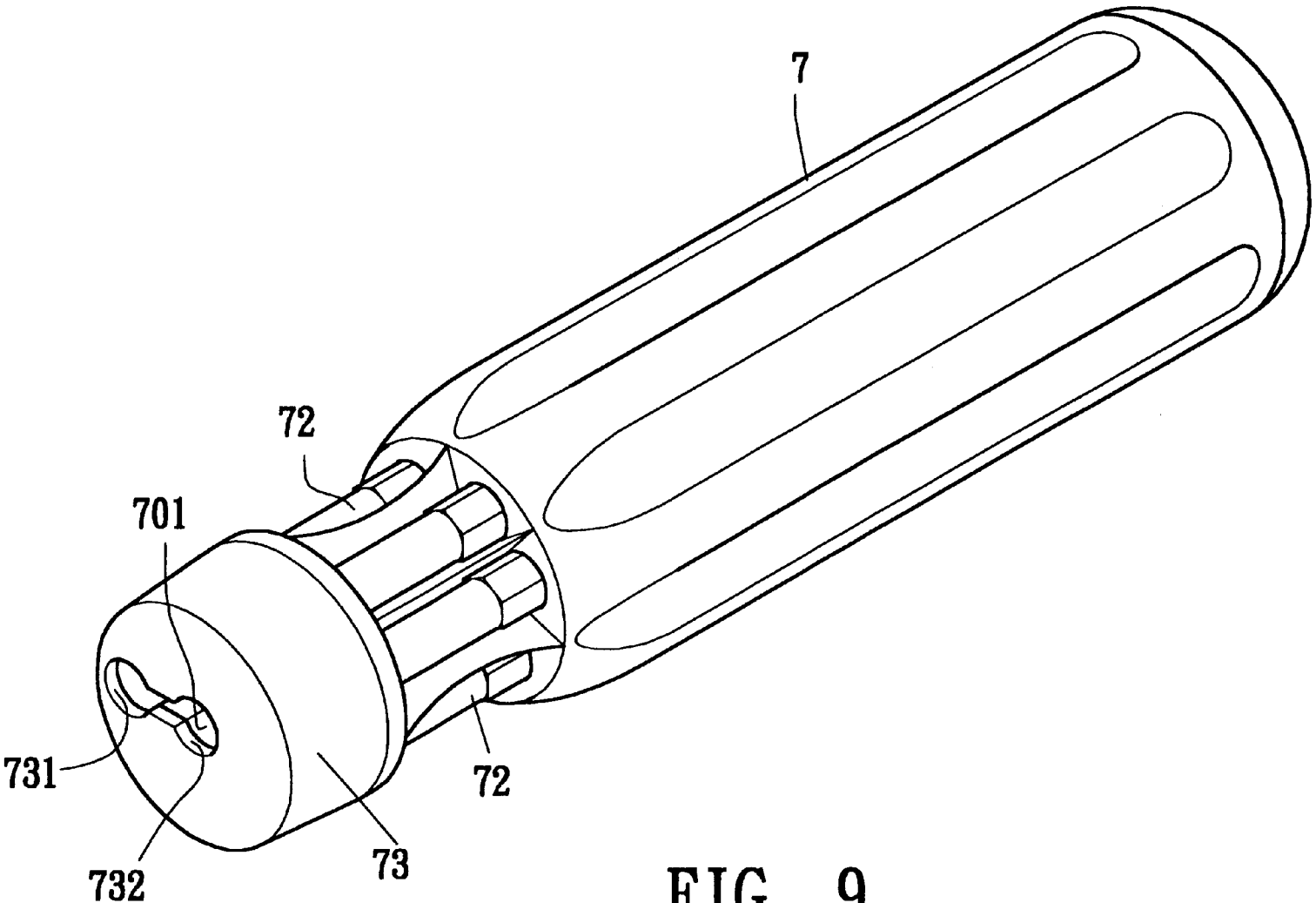
FIG. 9 PRIOR ART
FIG. 9 is a perspective view of another type of conventional screwdriver.
Figure 10:
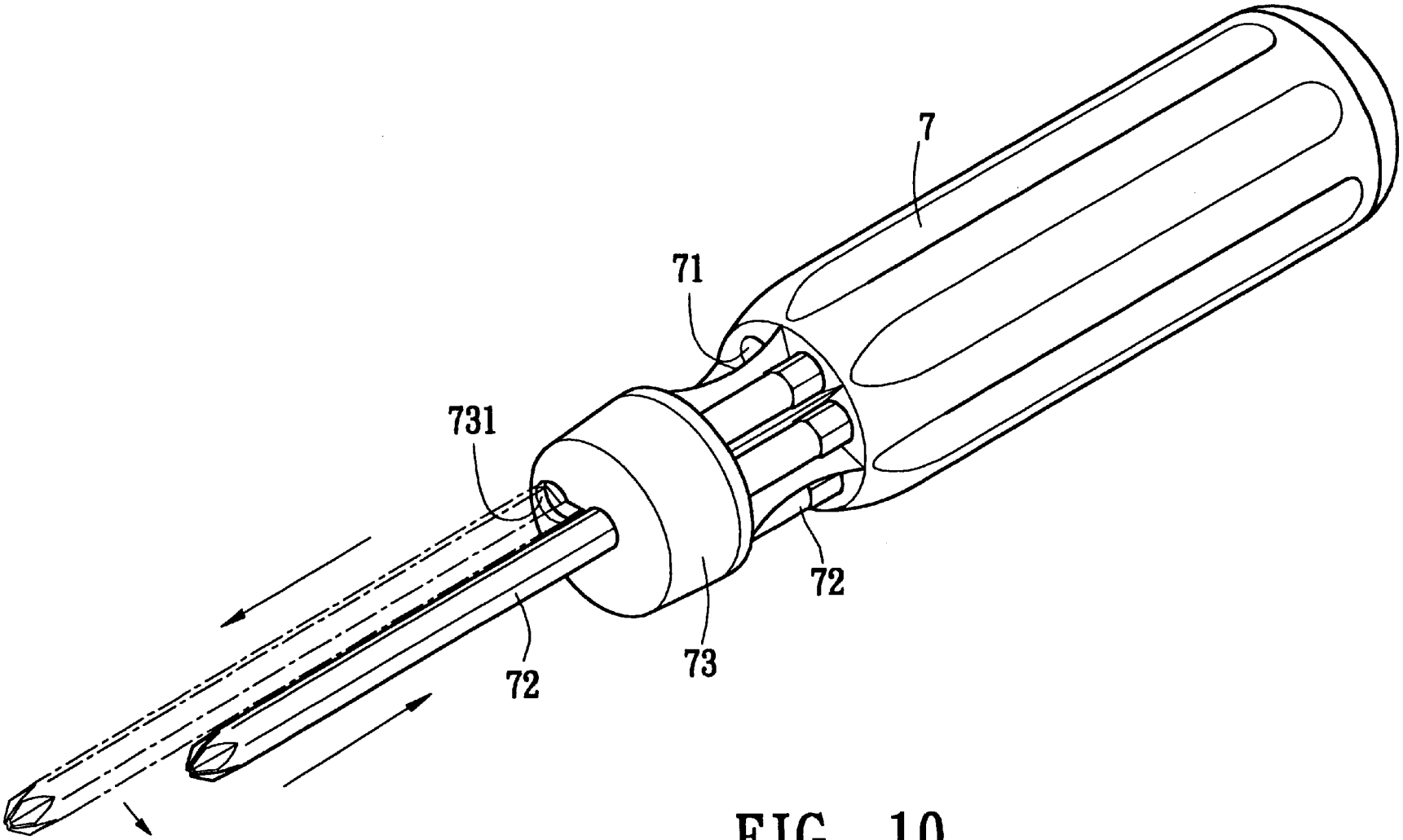
FIG. 10 PRIOR ART
FIG. 10 shows the use of the conventional screwdriver of FIG. 9.

In use, the cap member 15 is first rotated to align the opening 152 with the opening 141 of a receiving cavity 14 in which a desired tool head 4 is received. At this time, the protuberance 153 of the cap member 15 is engaged in a corresponding dent 104 to locate the cap member 15. Then the tool head 4 can be taken out and inserted into the tool connecting section 32 of the sleeve 3 as shown in FIGS. 5 and 6. Then the cap member 15 rotated to engage the protuberance 153 into the second dent 105 adjacent to the dent 104. Under such circumstance, the opening 152 of the cap member 15 is disaligned from any of the openings 141 of the receiving cavities 14 so as to seal the receiving cavities 14 and enclose the tool heads 4. Then the screwdriver can be used. The large diameter section 31 of the sleeve 3 is engaged in the enlarged section 131 of the central hole 13 of the grip 1 so that when using the tool head 4, the large diameter section 31 is leant against the enlarged section 131 of the central hole 13 to bear the axial application force of the tool head 4. Therefore, the grip 1 can be bear greater axial force and the screwdriver of the present intention is more durable. Various kinds of tool heads 4 can be placed in the receiving cavities 14 of the circumference of the grip 1 so as to greatly reduce the volume of the tool kit for easy carriage. Furthermore, the tool heads 4 are free from any enlarged section so that they can be easily manufactured.

In conclusion, the connecting rod 22 of the ratchet mechanism 2 disposed in the grip 1 is connected with the sleeve 3 fitted into the grip 1 from front end 103 thereof. The tool head 4 is connected with the sleeve 3. The sleeve 3 has a large diameter section 31 and the central hole 13 of the grip 1 has an enlarged section 131 for the large diameter section 31 of the sleeve 3 to engage therein. The large diameter section 31 of the sleeve 3 is leant against the enlarged section 131 so as to bear greater axial application force in use of the screwdriver. Therefore, the screwdriver is more durable. Moreover, various kinds of tool heads 4 can be placed in the receiving cavities 14 of the grip 1 so as to greatly reduce the volume of the tool kit for easy carriage.

The above embodiment is only used to illustrate the present invention, not intended to limit the scope thereof. Many modifications of the above embodiment can be made without departing from the spirit of the present invention.

What is claimed is:

1. A screwdriver grip structure comprising:

an elongated grip body having a posterior end and an anterior end and having formed therein:

(a) a differential hole having a plurality of longitudinally extending walls extending longitudinally anterior from said posterior end, wherein said walls of said differential hole are arranged in a predetermined transverse cross-sectional profile;

(b) a central bore extending longitudinally through said elongated grip body, said central bore being terminated at said posterior end by said differential hole and terminated at said anterior end by a counterbore, where a posterior end of said counterbore defines a pressure-bearing shelf;

(c) a plurality of elongated tool-receiving cavities radially distributed about said central bore, wherein each of said elongated tool-receiving cavities extends longitudinally posterior from said anterior end, said plurality of elongated tool-receiving cavities to store a corresponding plurality of elongated tool heads; and (d) a switch window extending through a longitudinal wall of said elongated grip body into said differential hole;

a ratchet mechanism to be inserted into said differential hole, said ratchet mechanism including:

(a) a ratchet seat having a transverse cross-sectional profile complementary to said transverse cross-sectional profile of said differential hole;

(b) a connecting rod having at one end a ratchet wheel disposed thereon; and (c) a switch for selectively controlling a rotational direction of said ratchet wheel;

an end cap for closing said differential hole at said posterior end of said elongated grip body, whereby said ratchet mechanism is retained in said differential hole and said switch protrudes through said switch window;

a drive shaft to be inserted into said central bore, said drive shaft including:

(a) a connecting sleeve disposed on a posterior end of said drive shaft, said connecting sleeve having an inner transverse cross-sectional profile corresponding to an outer transverse cross-sectional profile of said connecting rod;

(b) a drive head disposed on an anterior end of said drive shaft, said drive head having an outer diameter and longitudinal extent corresponding to a diameter and longitudinal extent, respectively, of said counterbore; and (c) a tool connection cavity formed in said drive head for inserting a user-selected tool head therein;

wherein said drive shaft is of sufficient length for said connecting sleeve to be mechanically engaged with said connecting rod while said drive head is in contact with said pressure-bearing shelf.

2. The screwdriver grip structure as recited in claim 1, wherein an annular groove is formed a predetermined distance from said anterior end of said elongated grip body, said annular groove corresponding in position to a stop flange formed on a rotary cap member, wherein said rotary cap member has further formed thereon:

(a) a central opening; and (b) an off-axis opening formed at a radial distance from said central opening corresponding to locations of said plurality of tool-receiving cavities, where said rotary cap member is installed on said anterior end of said elongated grip body and retained by a cooperating coupling of said stop flange in said annular groove and wherein said rotary cap member is rotatable so that said off-axis opening can be aligned with one of said plurality of tool-receiving cavities for access to a user selected one of said plurality of elongated tool heads.

3. The screwdriver grip structure as recited in claim 2, wherein an inner circumference of said rotary cap member has disposed thereon a protuberance and an outer circumference of said anterior end of said elongated grip body has formed thereon a plurality of dents, whereby said off-axis opening of said rotary cap member is aligned with one of said plurality of tool-receiving cavities when said protuberance is engaged with one of said plurality of dents.

4. The screwdriver grip structure as recited in claim 1, wherein said ratchet mechanism further includes a chuck plate inserted into said ratchet seat for retaining said ratchet wheel in said ratchet seat, and a stop plate installed in said ratchet seat and manipulated by said switch to selectively control said rotational direction of said ratchet wheel.

* * * * *